US006056131A

United States Patent [19]

Mowbray

[11] Patent Number: 6,056,131

[45] Date of Patent: May 2, 2000

[54] FOLD AWAY SUPPORT INCLUDING A PLURALITY OF BOOM MEMBERS JOINED BY FLEXIBLE LINKING STRUCTURE

[76] Inventor: Alan Couslon Mowbray, "Yonder " Riversdale RD., Kiama NSW, Australia, 2533

[21] Appl. No.: 08/676,787

[22] Filed: Jul. 8, 1996

[51] Int. Cl.[7] ..... A47H 1/00

[52] U.S. Cl. ..... 211/104; 211/96; 211/119.01; 248/220.1; 248/300

[58] Field of Search ..... 211/96, 1.3, 119.01, 211/104, 99; 248/300, 289.11, 220.1

[56] References Cited

U.S. PATENT DOCUMENTS

| | | | |
|---|---|---|---|
| 1,041,671 | 10/1912 | Reeser | 211/96 X |
| 1,162,298 | 11/1915 | Metcalf | 211/96 |
| 1,839,607 | 1/1932 | Slauson | 248/289.11 X |
| 2,692,054 | 10/1954 | Berglund | 248/289.11 X |
| 2,805,779 | 9/1957 | Caverley | 211/96 |
| 3,935,949 | 2/1976 | Cohen | 211/96 X |
| 4,049,225 | 9/1977 | Chasen et al. | 248/220.1 X |
| 4,077,597 | 3/1978 | Greig | 248/289.11 X |
| 5,570,642 | 11/1996 | Lehrman | 211/104 X |

FOREIGN PATENT DOCUMENTS

| | | | |
|---|---|---|---|
| 1333012 | 9/1962 | France | 211/96 |
| 1514261 | 1/1967 | France | 211/95 |

*Primary Examiner*—Donald P. Walsh
*Assistant Examiner*—Emmanuel M. Marcelo
*Attorney, Agent, or Firm*—Townsend and Townsend and Crew LLP

[57] ABSTRACT

A fold away support having a top bracket and a bottom bracket that are attached to a wall. Pivotally connected to each of the brackets are a plurality of boom members, each having an upper and a lower arm. Flexible linking structure links adjacent boom members, such that in use the boom members pivot apart, tensioning the linking structure. The support can thus be used as a fold away clothes line or tarpaulin support for a sun shade.

10 Claims, 7 Drawing Sheets

FOLD AWAY SUPPORT INCLUDING A PLURALITY OF BOOM MEMBERS JOINED BY FLEXIBLE LINKING STRUCTURE

BACKGROUND OF THE INVENTION

1. Field of the Invention

The present invention relates to a fold away support and in particularly to a clothes line.

2. Description of the Prior Art

Originally clothes lines were unmovable fixtures in the yard. Many types of clothes lines have been produced that are removable or foldable. These take several forms, from foldable rotary clothes lines, to ones which pull out from the wall and attach to posts in the ground. Not all of the existing clothes lines are suitable for every situation, particularly for small inner city yards.

SUMMARY OF THE INVENTION

In one broad form the present invention comprises a fold away support, adapted to be secured to a wall, comprising:

a first bracket adapted to be secured to said wall;

a second bracket adapted to be to be secured to said wall and spaced apart from said first bracket;

a plurality of boom members, each having an upper and lower arm joined at one end and having a free end, with the free end of the upper arm pivotally connected to the first bracket and the free end of the lower arm pivotally connected to the second bracket; and flexible linking means linking adjacent boom members, whereby in use the boom members are pivoted apart, tensioning the linking means.

In another form the present invention comprises a fold away clothes line adapted to be secured to a wall, comprising:

a first bracket adapted to be secured to said wall;

a second bracket adapted to be secured to said wall and spaced apart from said first bracket;

a plurality of boom members, each having an upper and lower arm joined at one end and having a free end, with the free end of the upper arm pivotally connected to the first bracket and the free end of the lower arm pivotally connected to the second bracket; and a plurality of resilient flexible elongated members linking adjacent boom members, whereby in use the boom members are pivoted apart, tensioning the plurality of resilient flexible elongated members.

DETAILED DESCRIPTION OF THE PREFERRED EXEMPLARY EMBODIMENTS

Figure 1:
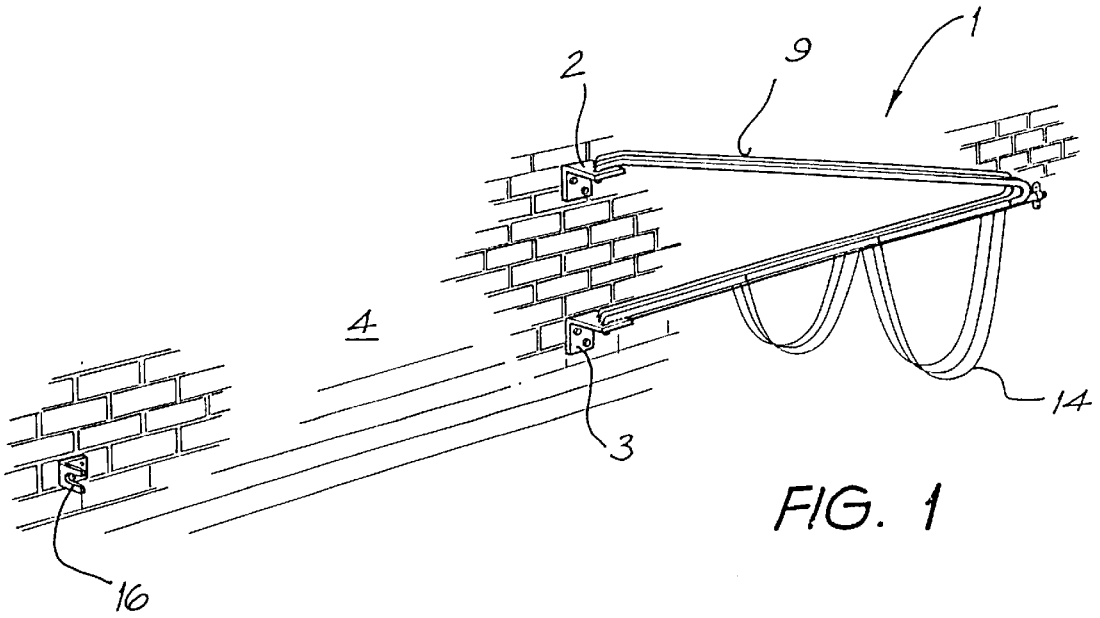
FIG. 1 illustrates a clothes line in accordance with one embodiment of the present invention, shown in its folded position.
Figure 2:
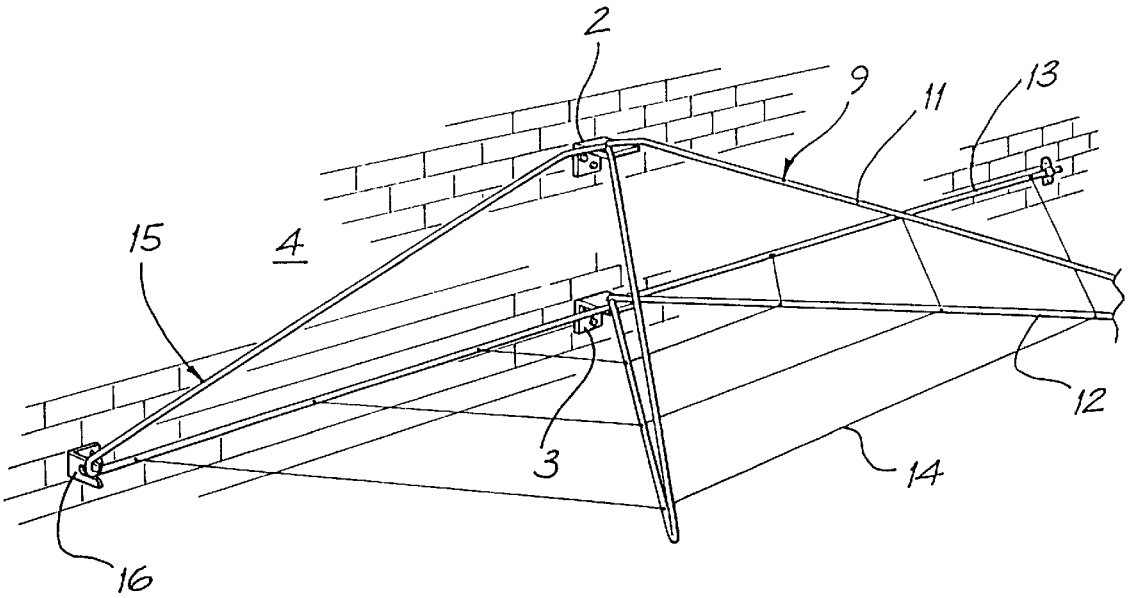
FIG. 2 shows the clothes line of FIG. 1 in its extended position.
Figure 5:
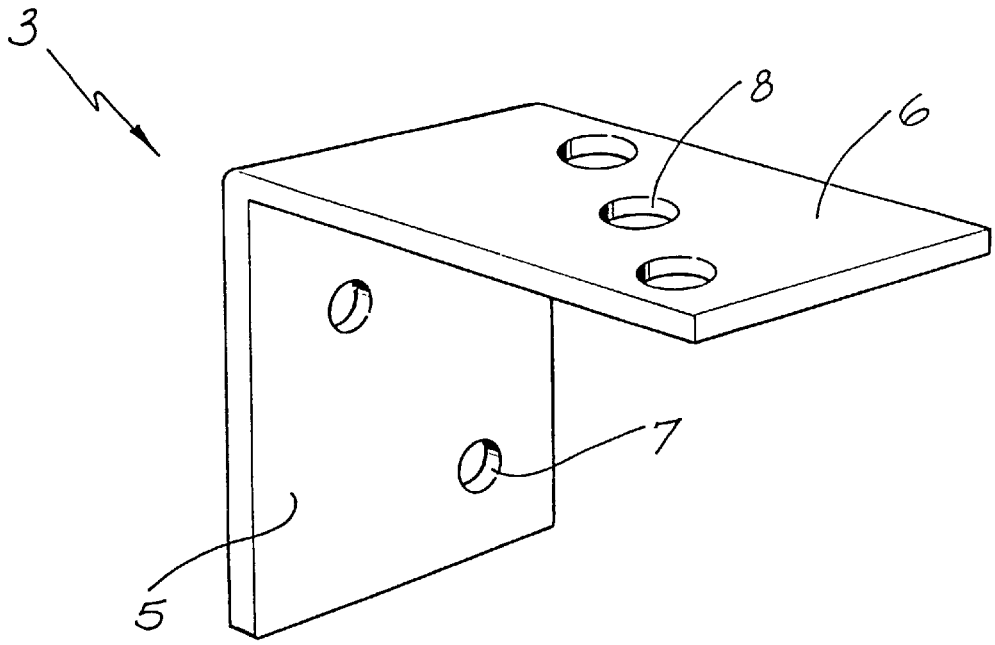
FIG. 5 shows a bracket illustrated in FIGS. 1 & 2.

One embodiment of the present invention is shown in FIGS. 1 & 2. A clothes line (1) includes an upper bracket (2) and a lower bracket (3), mounted to a wall (4). The bracket is shown in detail in FIG. 5, and includes a wall mounting section (5), having two holes (7) and a pivot portion (6) with, in this case, three pivot holes (8). The brackets (2 & 3) are affixed to the wall (4) by means of bolts secured through the holes (7).

Figure 7:
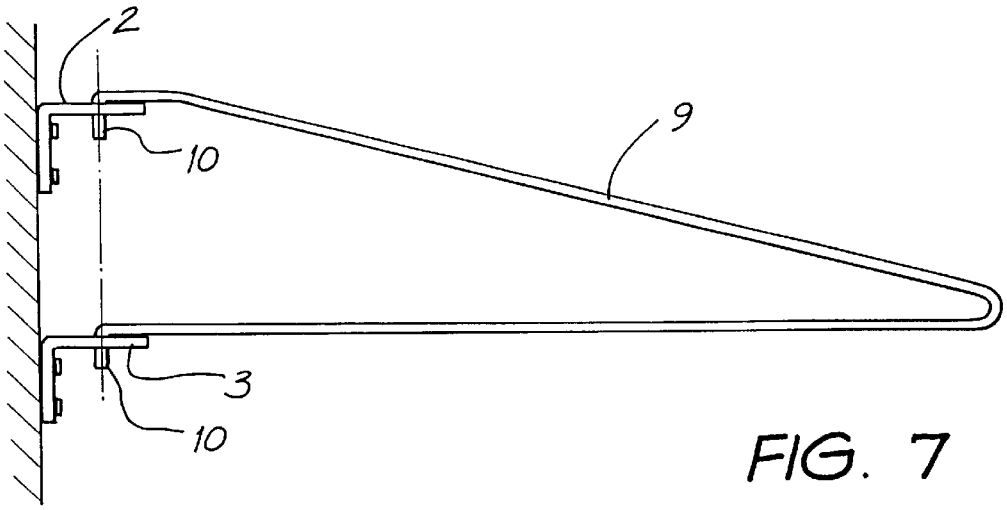
FIG. 7 illustrates one means of attaching the boom to the brackets according to the embodiment shown in FIGS. 1 to 4.

Boom members (9) are secured to the brackets (2 & 3) by means of their free ends (10) of the upper (11) and lower (12) arms engaging, as shown in FIG. 7, in the pivot holes (8) of the respective upper bracket (2) and the lower bracket (3). Preferably the boom members (9) are made of tubular steel or aluminum, and can be painted or color bonded. As shown in FIG. 1, an arm member (13) is secured to the wall. A number of wires or lines (14) extend from the arm member (13) and are supported by the boom members (9) and are affixed to the outer boom member (15).

The boom members (9) are so position ed on the pivot section (6) of the brackets (2 & 3) that, when the outer boom (15) is moved to its fully open position and latched to the wall (4) by means of a releasable latch (16), as shown in FIG. 2, the boom members (9) are positioned at preselected degrees in the array. Further, in this position, the lines (14) are tensioned. The boom members (9) can be of any suitable length. If desired the positions of the boom members can be adjustable to accommodate the width of the clothing being hung on the line.

Figure 3:
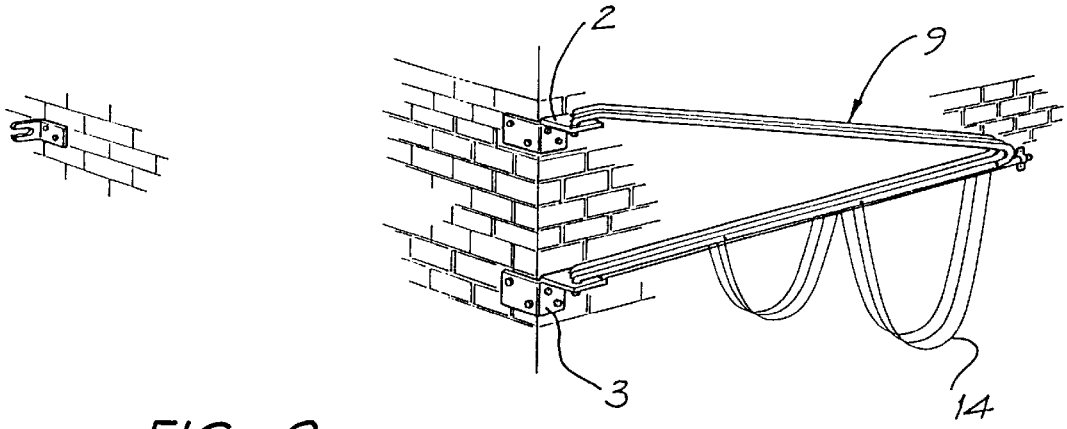
FIG. 3 shows a clothes line, in its folded position, according to another embodiment of the present invention.
Figure 4:
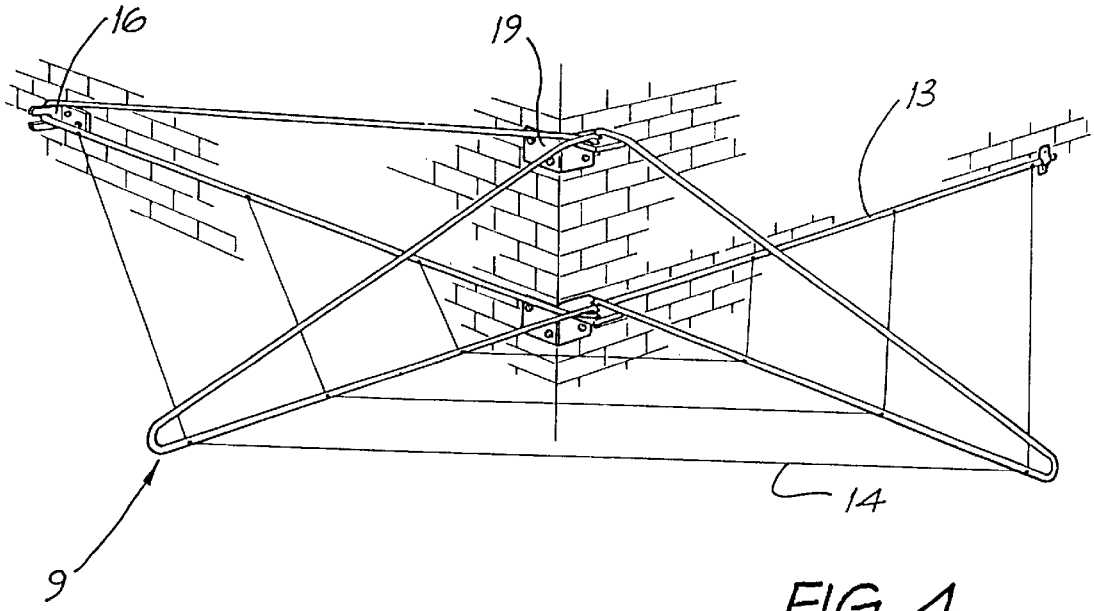
FIG. 4 shows the clothes line of FIG. 3, in its extended position.
Figure 6:
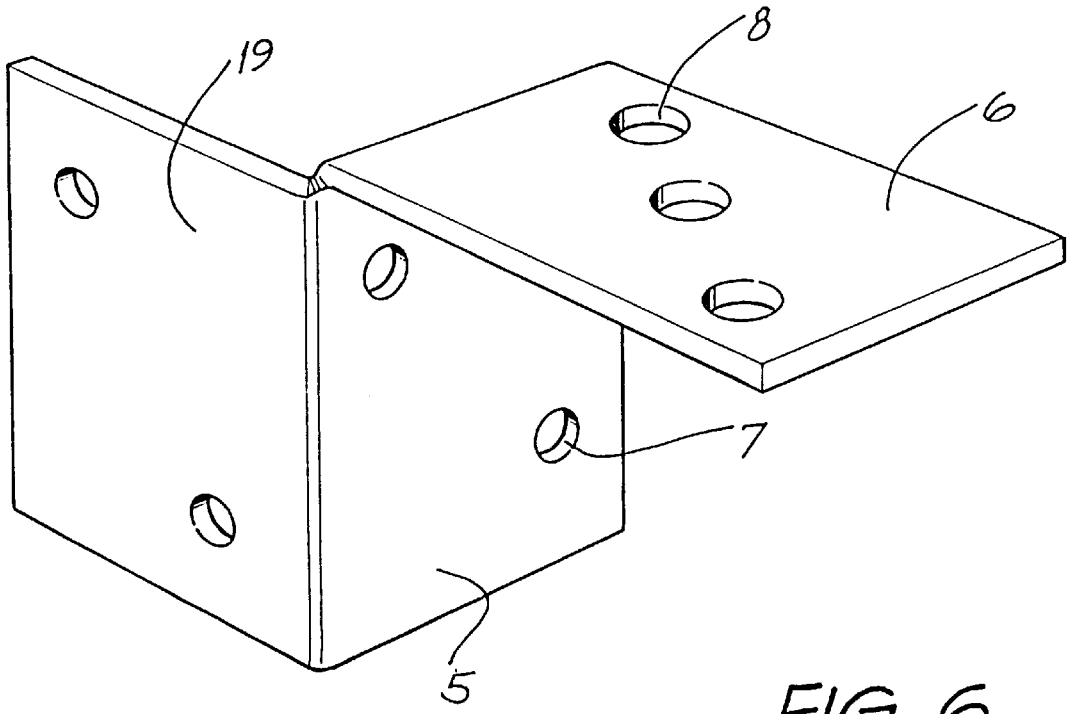
FIG. 6 illustrates a bracket illustrated in FIGS. 3 & 4.

A clothes line for attaching to the corner of a wall is shown in FIGS. 3 & 4, wherein the construction is similar to that of the previously described embodiment except for the shape of the brackets (17 & 18). As shown in FIG. 6, the bracket (17) has a side web (19), to add additional stability and correct positioning on the corner. Thus the clothes line can have a 270° array.

Figure 12:
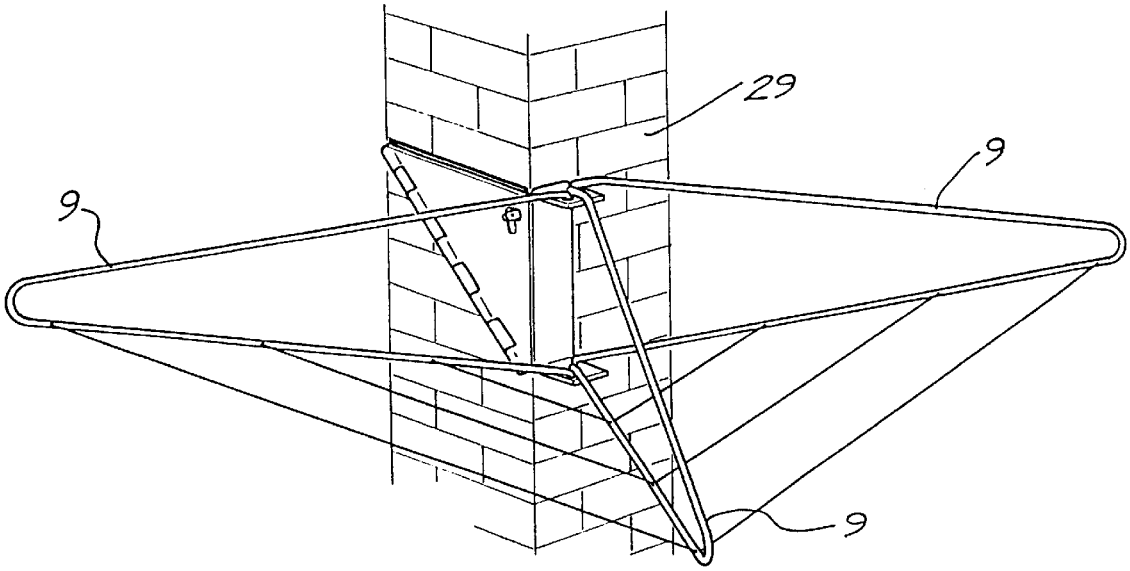
FIG. 12 illustrates a clothes line, according to a further embodiment of the present invention, in its extended position.
Figure 13:
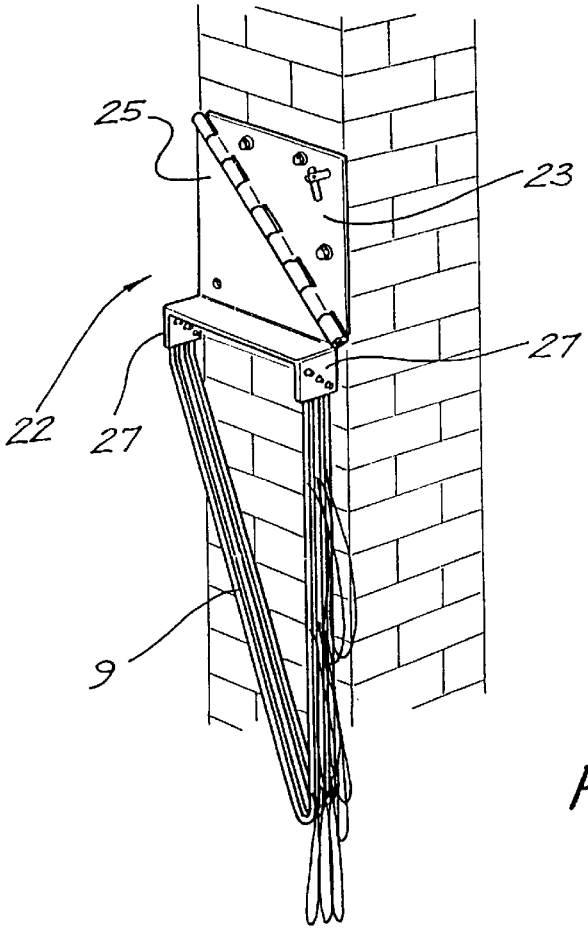
FIG. 13 illustrates the clothes line of FIG. 12 in its folded position.
Figure 14:
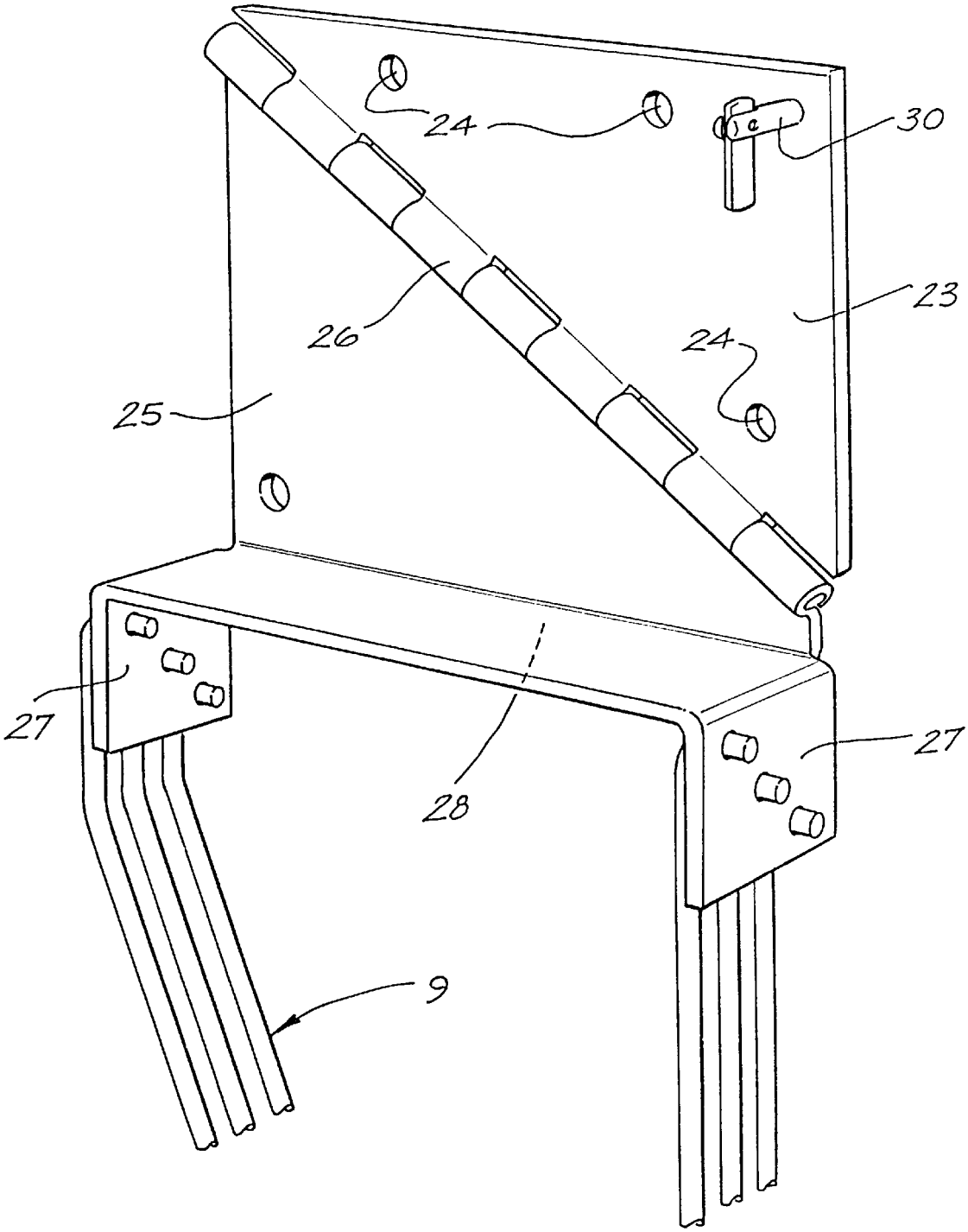
FIG. 14 is a more detailed view of the mounting bracket shown in FIGS. 12 & 13, in its stored or folded position.

A further embodiment is shown in FIGS. 12 to 14, which can be mounted on a corner of a wall or a pier. The mounting bracket (22) comprises a triangular wall mount (23), which is affixed to the wall or pier by means of bolts through the holes (24). A triangular support plate (25) is attached to the triangular wall mount (23) by hinge (26).

The upper (11) and lower (12) arms of the boom members (9) are attached to brackets (27) on the lower edge (28) of the support plate (25). The boom members (9) and the line are similar in construction to the embodiments previously described.

As shown in FIGS. 13 & 14, when the clothes line (1) is in its stored position, the support plate (25) is folded down against the pier (29) and the boom members (9) are folded together against the pier (29). To extend the clothes line (1) the support plate (25) is folded up against the wall mount (23), and secured there by the locking pin (30), as shown in FIG. 12. The brackets (27) fit onto the corner of the pier (29), and the booms members (9) are spread to form a 270° array. The boom members can be locked by any suitable means into their positions.

Figure 8:
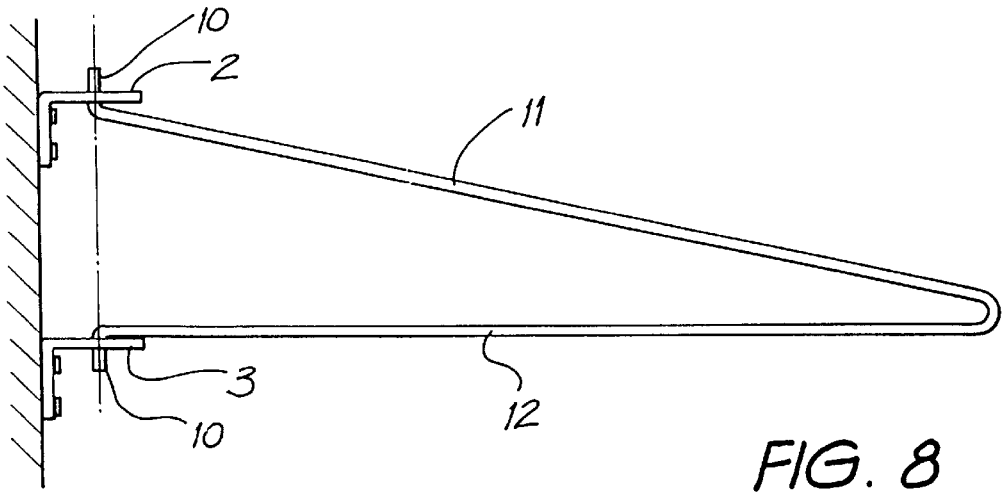
FIG. 8 illustrates a further means of attaching the boom to the brackets according to another embodiment of the present invention.
Figure 9:
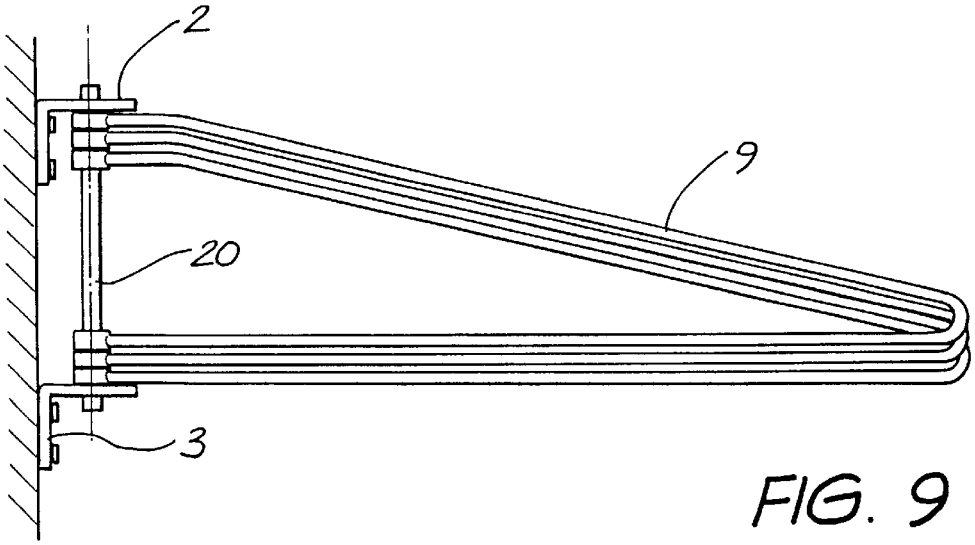
FIG. 9 illustrates yet a further means of attaching the boom to the brackets, according to another embodiment of the present invention.

The boom members (9) can be pivoted in any suitable manner, and as shown in FIG. 8, the free ends (10) of the arms (11 & 12) both engage outwardly through the holes (7) of the pivot portion (6) of the respective brackets (2 & 3). A further arrangement is shown in FIG. 9 wherein all of the boom members (9) are pivoted from a central post (20) as shown in FIG. 9.

Figure 10:
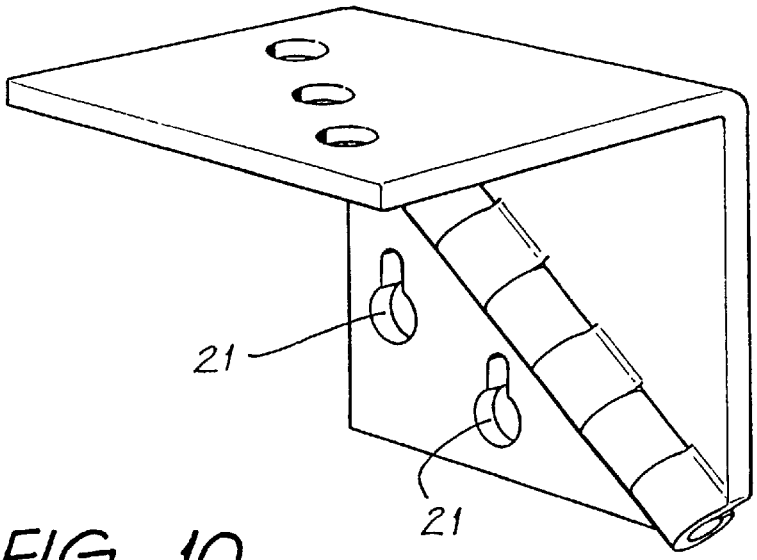
FIG. 10 illustrates a removable bracket suitable for one embodiment of the present invention.

Additionally the brackets (2 & 3) could be releasably mounted on the wall by means of key hole mounts (21) as shown in FIG. 10.

Figure 11:
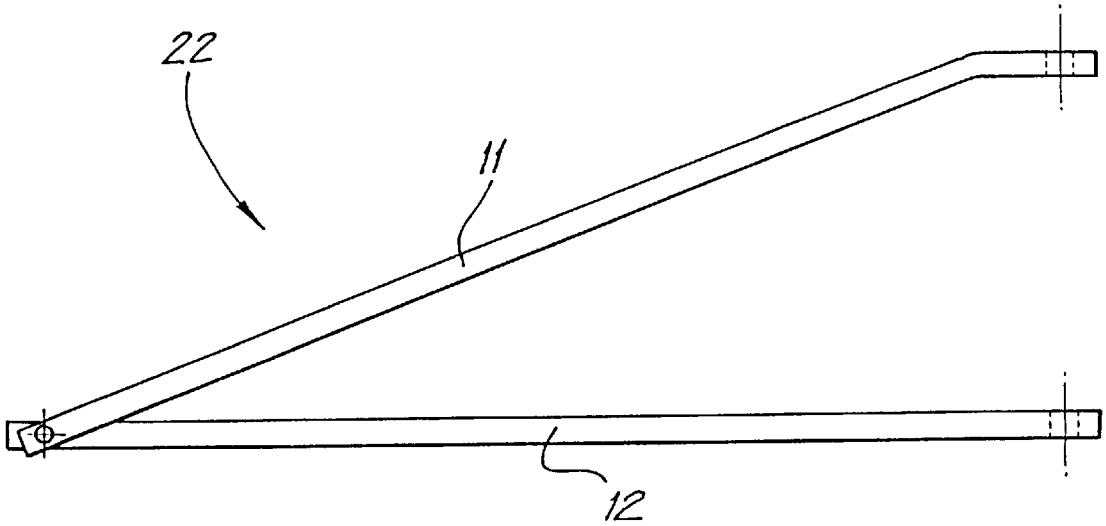
FIG. 11 illustrates a boom according to another embodiment of the present invention.

An adjustable boom member (22) is shown in FIG. 11, wherein the arms (11 & 12) are joined by means of a bolt or hinge such that their respective angular displacement can be adjusted to allow for height and distance adjustment of the brackets.

Further the clothes lines can be mounted to parallel the slope of the land, a feature which is most advantageous for sloping blocks. The invention could also be mountable on caravans or the like, either permanently or removably for travelling.

The present invention is not limited to a clothes line, as a tarpaulin or shade cloth or the like, could be attached to the boom members, instead of or as well as the lines, to form a shelter.

It should be obvious to people skilled in the art that modifications or alterations to the above described embodiments could be carried out without departing from the spirit or scope of the present invention.

What is claimed is:

1. A fold away support, adapted to be secured to a wall, comprising:

a first bracket adapted to be secured to said wall;

a second bracket adapted to be secured to said wall and spaced apart from said first bracket;

a first boom member and an outer boom member with at least one boom member therebetween, each boom member having an upper and a lower arm joined at one end with the other end of the upper arm pivotally connected to the first bracket and the other end of the lower arm pivotally connected to the second bracket;

a wall mount adapted to be connected to said wall, and located adjacent said first boom member;

flexible linking means linking said wall mount to said first boom member and linking adjacent boom members, such that said boom members are adapted to pivot from a closed overlapping position to an extended array, tensioning the linking means and holding the boom members in position; and a releasable latch to which the outer boom member is adapted to be releasably affixed to hold the boom members in the extended array.

2. A fold away support according to claim 1, wherein each boom member is a one-piece tubular construction.

3. A fold away support according to claim 1, wherein the support brackets are substantially L-shaped.

4. A fold away support according to claim 1, wherein the bracket has a side web adapted to engage on the corner of a wall, such that the boom members form an array extending around the corner of the wall.

5. A fold away support according to claim 1, wherein each of said boom members comprise two separate arms which are angularly adjustable with respect to each other.

6. A fold away clothes line, adapted to be secured to a wall, comprising:

a first bracket adapted to be secured to said wall;

a second bracket adapted to be secured to said wall spaced apart from said first bracket;

a first boom member and an outer boom member with at least one boom member therebetween, each boom member having an upper and a lower arm joined at one end with the other end of the upper arm pivotally connected to the first bracket and the other end of the lower arm pivotally connected to the second bracket;

a wall mount adapted to be connected to said wall, and located adjacent said first boom member;

a plurality of flexible linking means linking said wall mount to said first boom member and linking adjacent boom members, such that said boom members are adapted to pivot from a closed overlapping position to an extended array, tensioning the linking means and holding the boom members in position; and a releasable latch to which the outer boom member is adapted to be releasably affixed to hold the boom members in the extended array.

7. A fold away clothes line according to claim 6, wherein each boom member is a one-piece tubular construction.

8. A fold away clothes line according to claim 6, wherein the support brackets are substantially L-shaped.

9. A fold away clothes line according to claim 6, wherein the bracket has a side web adapted to engage on the corner of a wall, such that the boom members form an array extending around the corner of the wall.

10. A fold away clothes line according to claim 6, wherein the boom member comprises two separate arms which angularly adjustable with respect to each other.

* * * * *